United States Patent [19]

Steinbrenner et al.

[11] Patent Number: 5,072,712

[45] Date of Patent: Dec. 17, 1991

[54] METHOD AND APPARATUS FOR SETTING A TANK VENTING VALVE

[75] Inventors: Ulrich Steinbrenner, Stuttgart; Günther Plapp, Filderstadt; Wolfgang Wagner, Korntal-Münchingen, all of Fed. Rep. of Germany

[73] Assignee: Robert Bosch GmbH, Stuttgart, Fed. Rep. of Germany

[21] Appl. No.: 455,427

[22] PCT Filed: Mar. 4, 1989

[86] PCT No.: PCT/DE89/00137

§ 371 Date: Dec. 20, 1989

§ 102(e) Date: Dec. 20, 1989

[87] PCT Pub. No.: WO89/10472

PCT Pub. Date: Nov. 2, 1989

[30] Foreign Application Priority Data

Apr. 20, 1988 [DE] Fed. Rep. of Germany ..... 3813220

[51] Int. Cl.[5] ..... F02D 41/14; F02M 25/08

[52] U.S. Cl. ..... 123/489; 123/520

[58] Field of Search ..... 123/440, 489, 520

[56] References Cited

U.S. PATENT DOCUMENTS 4,664,087 5/1987 Hamburg ..... 123/520

4,683,861 8/1987 Breitkreuz et al. ..... 123/520

4,741,318 5/1988 Kortge et al. ..... 123/520

*Primary Examiner*—Tony M. Argenbright

*Attorney, Agent, or Firm*—Walter Ottesen

[57] ABSTRACT

A method is disclosed for obtaining output values for actuating a tank venting valve connected to the intake pipe of an internal combustion engine. A control factor is supplied by a lambda controller computing step and modifies a loading factor until a regenerating fuel quantity leading to no deviation from the lambda desired value is supplied via the tank venting valve. The controlled loading factor modifies precontrol values for the regenerating fuel quantity which is supplied in an operating condition. The method takes into consideration the pressure conditions at the tank venting valve. This makes it possible to place the opening of the tank venting pipe into the intake pipe of an internal combustion engine behind the throttle flap where there is a great negative pressure, which, however, can fluctuate within wide limits. The method takes into consideration these fluctuations within a precontrolled system with superposed control which makes it possible to operate with high regenerating gas flows and, nevertheless, reliable operation. An apparatus for carrying out the method of the invention is also disclosed.

17 Claims, 3 Drawing Sheets

METHOD AND APPARATUS FOR SETTING A TANK VENTING VALVE

FIELD OF THE INVENTION

The invention relates to a method and apparatus for setting a tank venting valve which connects a container in which fuel vapors are temporarily stored to the intake pipe of an internal combustion engine.

BACKGROUND OF THE INVENTION

A method and apparatus for setting a tank venting valve are known from U.S. Pat. No. 4,683,861. The method described there utilizes the lambda control factor which is supplied by a lambda controller function unit for controlling the lambda value of the air/fuel mixture to be supplied to the internal combustion engine. This factor is used for modifying values of a precontrol variable for a pulse duty factor for activating the tank venting valve. These values are stored in a memory addressable via the rotational speed and a load-dependent variable.

The known method works on the condition that essentially the same negative pressure continuously exists at the negative-pressure side of the tank venting valve, that is, at the opening of the tank vent into the air duct of the internal combustion engine. This assumes that the opening is located in front of the throttle flap. If, nevertheless, different negative pressures occur in dependence on different loads, this is taken into consideration by the fact that the values of the precontrol variable are stored in dependence on load. In the above-mentioned publication, however, it is expressly mentioned that greater pressure differences between different load conditions cannot be adequately taken into consideration.

Behind the throttle flap there is a much stronger negative pressure in the intake pipe than in front of it, especially when the flap is not completely opened. The consequence is that when the tank vent opens into the air duct, that is, into the intake pipe, behind the throttle flap instead of in front of it, much higher gas throughputs can be achieved with the cross sections of the tank venting lines remaining the same. Thus, the intermediate store, which as a rule is filled with active carbon, can be better and more quickly regenerated. The known method and the known apparatus, however, are not capable of satisfactorily controlling the fuel quantity to be supplied to the internal combustion engine in this case.

The invention is based on the object of specifying a method and an apparatus for setting a tank venting valve. The method and the apparatus also lead to good control results for the total quantity of fuel to be supplied to an internal combustion engine if the method and the apparatus are to be used in a system in which the tank vent is connected into the air duct of an internal combustion engine behind the throttle valve.

SUMMARY OF THE INVENTION

It is of particular significance for the method according to the invention that it calculates the maximum possible gas flow through the tank venting valve at the pressure conditions prevailing in a respective operating condition. This maximum gas flow is taken into consideration in predetermined precontrol values of a variable which is a measure of the desired regenerating fuel quantity. These precontrol values are advantageously set in inversely proportional dependence on the calculated maximum gas flow. Relating them thus can be done either by addressing a memory with precontrol values which are stored there, via the maximum gas flow calculated for the operating condition present in each case, or by dividing a precontrol value, which is determined without the dependence on the maximum gas flow, by the value of the maximum gas flow present in each case. In addition, the precontrol values are set in proportional dependence on the air mass flow through the intake pipe. This interdependence too can be effected by means of one of the two modes just described.

The precontrol values are modified by dividing by a loading factor which, starting with its present value in each case, is preferably changed step-by-step in dependence on the particular value of the lambda control factor then present in such a manner that it leads to a change in the regenerating fuel quantity to be supplied, in the particular direction which results in a change of the lambda control factor towards a control factor desired value. The desired value is typically the value one. Modification also includes a control to the divided value. The above-mentioned modification can be effected at the precontrol values before these are placed in the dependence mentioned above, or also thereafter.

The modified values placed in dependence are finally converted into an output value for the tank venting valve, typically a pulse duty factor.

When an internal combustion engine is supplied with fuel via a tank venting valve and not only via a fuel metering device, typically an injection valve arrangement, the result is that the two component quantities of fuel must be matched to one another for correct operation. For this purpose, with the method according to the invention, the output value to be supplied to the fuel metering device is reduced in order to reduce the quantity of fuel supplied to the internal combustion engine by this device in comparison with the state in which no fuel is supplied via the tank venting valve. The reduction is in each case effected to such an extent that the metering device supplies to the internal combustion engine that quantity of fuel less by which the supply via the tank venting valve is increased.

To carry out the above method, an apparatus according to the invention at least requires a regenerating precontrol value memory, through-flow determining means, loading controller means, converting means and compensating means. The regenerating precontrol value memory stores preliminary values for the regenerating gas flow and is addressable by values of the rotational speed, of the air flow and of the maximum possible gas flow through the tank venting valve. The maximum possible values for the gas flow through the tank venting valve are determined by the through-flow determining means for the operating condition present in each case. The loading controller means determines the above-mentioned loading factor and divides the precontrol values by this loading factor, the precontrol values being read out for a particular set of values of addressing operating variables. In a subsequent step within the loading controller means, the system is then controlled to the divided value. The controlled value is converted by the converting means into an output value for the actuator of the tank venting valve. The compensating means performs the above-mentioned reduction of the output value to be supplied to the fuel-metering device.

The above-mentioned means of the device can be realized by individual special components implemented in hardware or by means of the known functions of an appropriately programmed microcomputer, the second possibility being preferable in accordance with current technology.

Instead of with the mentioned minimal number of functional means, the method according to the invention can be implemented also with a greater number of such means, this number being greater in correspondence to the reduction of information already taken into consideration in the regenerating precontrol value memory. The dependencies not taken into consideration must then be established in special functional means.

Especially advantageous is a device which exhibits a regenerating precontrol value memory which stores fuel ratio numbers for the regenerating fuel mass/total fuel mass ratio and is addressable via values of the rotational speed and of a load-dependent variable.

The values to be stored in the memory in this case exactly correspond to that which is ultimately required, namely to replace a particular portion of total fuel by regenerating fuel. To convert the value read out in each case into a regenerating gas flow, that is into a variable which can be controlled by the tank venting valve, the apparatus has, immediately behind the precontrol value memory, a loading controller means which obtains a gas ratio number by dividing the fuel ratio number by the loading factor. From this ratio number, the actually required regenerating gas flow is obtained by multiplying by the air flow through the intake pipe and a constant in a multiplying step. In a dividing step, the maximum gas flow possible at the present instant is also taken into consideration, the value of which is determined by a through-flow determining means. A converting means calculates an output value for the actuator of the tank venting valve. A compensating means reduces the output value which is supplied to the fuel-metering device in accordance with the regenerating fuel quantity supplied.

In practice, the apparatus operating with these means can be particularly well adapted to different engine systems since it takes into consideration, in each case in separate mathematical steps, important variables which are of significance for the operation of the overall apparatus.

Any flow-controllable valve can be used as a tank venting valve. Use of a pulsed valve is particularly advantageous. The U.S. Pat. No. 4,683,861 already mentioned initially mentions a pulse frequency of 10 Hz as being advantageous. Without changing the frequency, the pulse duty factor is varied there for setting a required gas flow. The opening times and closing times of the valve thus vary within wide limits.

In an advantageous embodiment of devices according to the invention which, however, can also be used in any other devices for controlling a tank venting valve, the opening time or the closing time is set, depending on the pulse duty factor required, to the minimum value at which correct operation of the tank venting valve is still possible. Thus, it is not the pulse frequency which is kept constant but the opening tim with a predominantly closed valve. This has the advantage that the fastest possible changes between opening and closing, and thus good driving characteristics of the vehicle in which the device is used, are always achieved, even with unfavorable pulse duty factors. Only with extreme pulse duty factors, the pulse frequency becomes so low that, for example, the opening time becomes so great that it overlaps the intake periods of several cylinders. To prevent this, the pulse frequency is limited to a minimum value in accordance with an advantageous further embodiment. If this value is reached, the frequency is retained and the closing or opening time of the tank venting valve is set below that value which is actually required for correct operation. Although this leads to deviations from the desired values, this is less serious than a poor driving characteristic due to a pulse frequency which is too low.

BRIEF DESCRIPTION OF THE DRAWINGS

Embodiments of the invention are described in greater detail in the description following and are shown in the drawing, wherein.

DESCRIPTION OF THE PREFERRED EMBODIMENTS OF THE INVENTION

Figure 1:
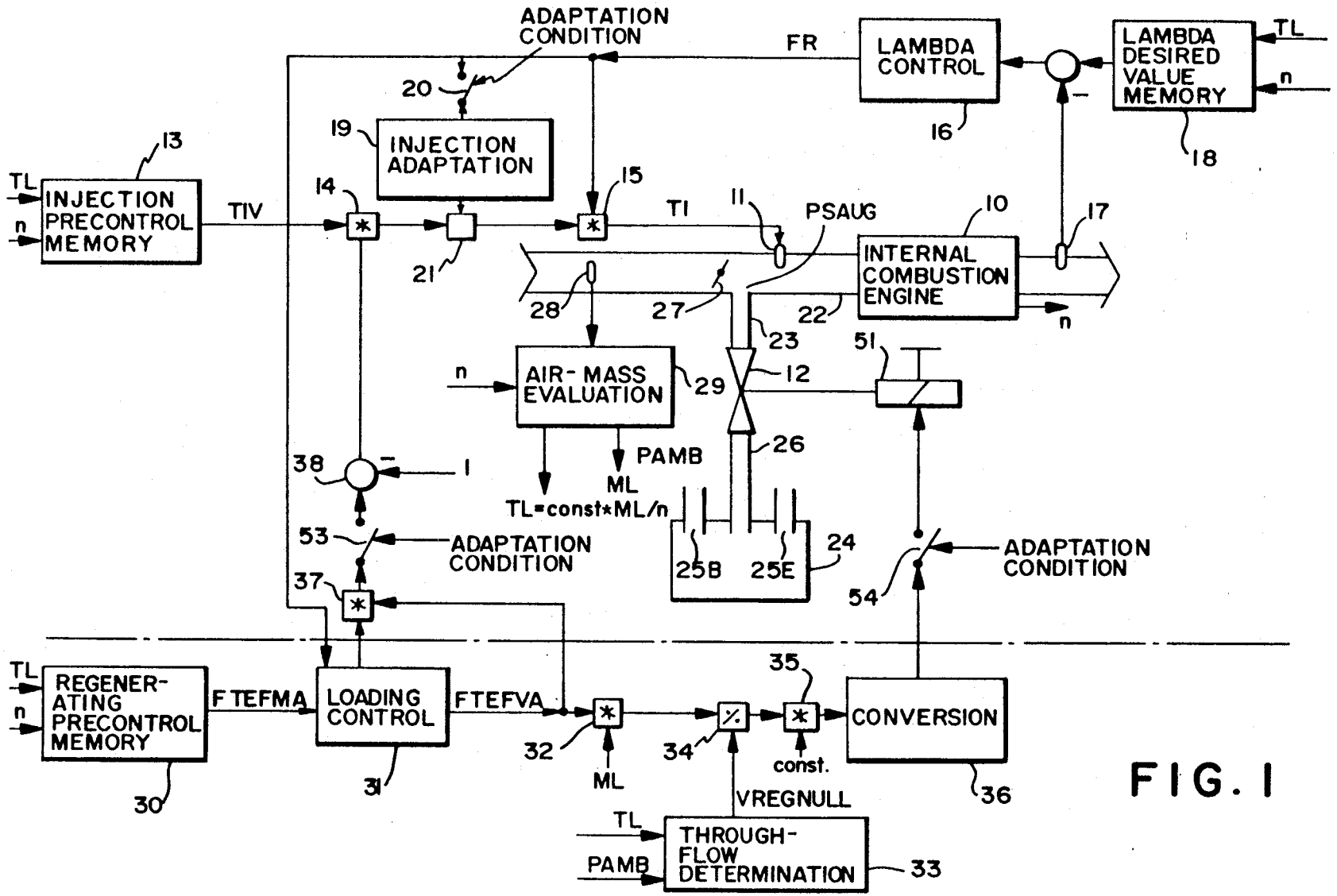
FIG. 1 shows a block diagram of a functional representation of a method for setting a tank venting valve, including a loading controller means and through-flow determining means.

FIG. 1 shows an internal combustion engine 10 with control of the injection time TI of an injection valve 11 and control of the pulse duty factor TAU of a tank venting valve 12.

The injection time is controlled as follows. From an injection precontrol value memory 13, preliminary injection times TIV dependent on the rotational speed n and a load-dependent variable TL are read out. The values reach a compensating multiplier step 14, the function of which will be discussed in connection with the control of the tank venting valve. After this multiplying step, the modified values reach a control factor multiplying step 15 where they are multiplied by a control factor FR which is supplied by a lambda control means 16 in dependence on a desired value/actual value difference. The actual value is obtained with the aid of a lambda probe 17. The desired value originates from a lambda desired value memory 18 which can be addressed via the rotational speed n and the load-dependent variable TL. If the fuel is not also controlled for lean values but only for a lambda value of one, there is no lambda desired value memory 18. In addition to the control factor multiplying step 15, the control factor is also supplied to an injection adaptation means 19 which carries out a learning process when a corresponding adaptation instruction has been fulfilled, which is indicated by a closable injection adaptation switch 20. The output signal of the injection adaptation means 19 also modifies the injection time. This is done by means of a logic operation means 21 which operates, for example, multiplicatively or also multiplicatively and additively, depending on the construction and operation of the injection adaptation means 19.

The above control loop for the injection time operates in such a manner that an injection precontrol time TIV is read out of the injection precontrol value memory 13 for the operating condition present in each case. This time is modified by means of the above-mentioned mathematical steps with the aid of the control factor FR in such a manner that the lambda desired value predetermined for the corresponding operating condition occurs.

The compensating multiplying step 14 has already been mentioned. This step is used for reducing the injection precontrol time when fuel is supplied to the intake pipe 22 of the internal combustion engine 10 not only via the injection valve 11 but also via a tank venting pipe 23.

The tank vent has a temporary reservoir 24 which, as a rule, is filled with active carbon. Its venting inlet 25E is connected to the fuel tank. During regeneration, air flows into the temporary reservoir through a ventilation inlet 25B at the ambient pressure PAMB. Its outlet 26 leads to the tank venting valve 23 which is connected to the intake pipe 22 via the tank venting pipe 23. In both these pipes, the intake pressure PSAUG exists. The tank venting pipe 23 opens into the intake pipe behind a throttle valve 27. As a result, the suction negative pressure is particularly strong, which leads to a high gas flow through the temporary reservoir 24 and thus to good regeneration results of the active carbon.

In addition to the injection valve 11 and the throttle flap 27, an air flow meter 28 is also arranged in the air duct which measures the air flow, that is the mass of air per unit of time through the air duct. The output signal of the air flow meter 28 is converted by an evaluating means 29, which is also supplied with the rotational-speed signal n, into an air flow signal ML and the previously mentioned load signal TL, the latter being proportional to the quotient of air flow and rotational speed.

It should be pointed out at this point that the load detection does not have to be effected by means of an air flow meter but can be done in any manner, for example by measuring the position of the accelerator pedal or of the throttle flap.

Before discussing in greater detail the mathematical steps for actuating the tank venting valve 12, the ideas utilized by the invention shall first be explained.

The tank venting valve 12 is not capable of controlling the regenerating fuel mass directly but can only exert direct influence on the regenerating gas flow. The actual requirement, however, is to have a particular quantity of fuel from the injection valve 11 and a particular quantity of fuel from the tank venting pipe 23 for any operating condition. Predetermined values must thus always be a measure of the ratio of regenerating fuel mass/total fuel mass. The regenerating gas flow corresponding to the required fuel mass depends on the loading factor FTEAD of the regenerating gas, that is, on the regenerating fuel mass/regenerating gas mass ratio. If the entire regenerating gas consists of fuel gas, the loading factor is one; if the regenerating gas only consists of air, the loading factor is zero.

The loading factor existing in each case is determined by the fact that, initially, the assumption of a particular value for the loading factor is made and with this assumption the regenerating gas flow is determined. If the assumption was wrong, the internal combustion engine 10 is supplied with another total fuel mass than assumed. This leads to a deviation of the control factor FR from one. The loading factor FTEAD initially assumed is changed, depending on the direction in which the control factor FR deviates from one, in each case in the direction which opposes the measured deviation of the control factor FR from one. Thus, the loading factor applicable to the existing operating conditions is controlled starting with the initially assumed value of the loading factor FTEAD.

The recognition that the gas flow through the tank venting valve depends on the pressure ratio between inlet-side pressure PAMB and outlet-side pressure PSAUG is of particular significance for the operation of the device for setting the tank venting valve 12. For each ratio, a particular maximum gas flow through the valve is obtained which is present with a continuously completely opened valve. This maximum possible flow is reduced by setting a pulse duty factor to the desired value. The maximum gas flow possible in any respective operating condition, that is, with particular pressure ratios, must be calculated.

For the determination of the regenerating gas flow, it must also be taken into consideration that the latter must be changed in proportion with the air flow ML through the intake pipe 22 in order to maintain a desired regenerating fuel mass/total fuel mass ratio.

Figure 2:
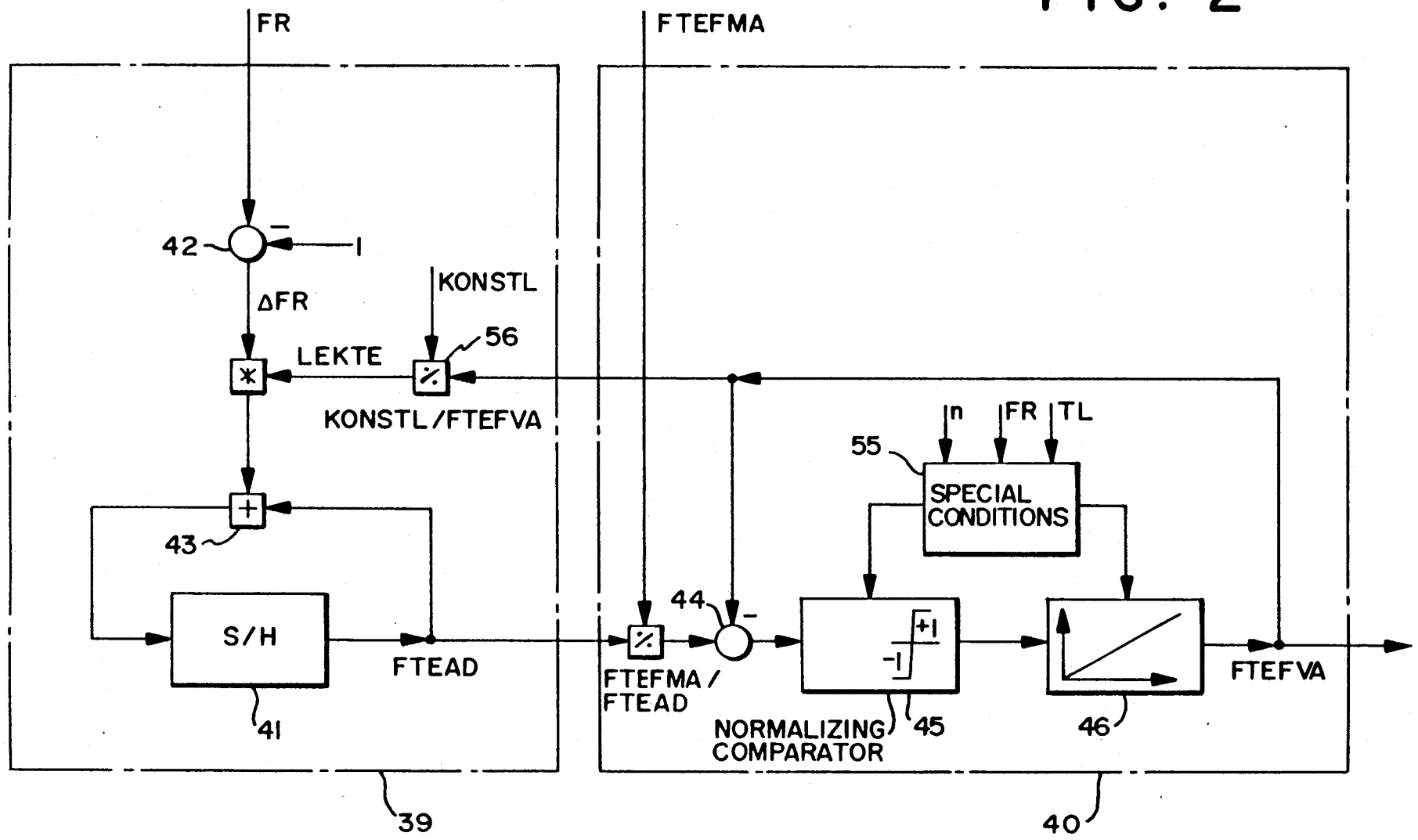
FIG. 2 shows a block diagram of a functional representation of the loading controller means in the method of FIG. 1.
Figure 3:
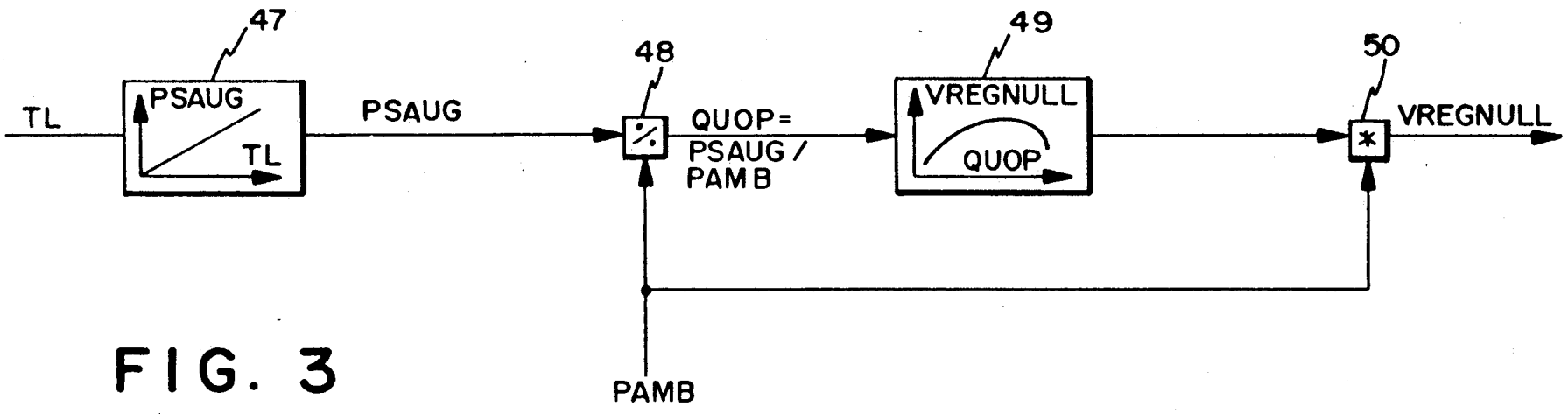
FIG. 3 shows a block diagram of a functional representation of the through-flow determining means in the method of FIG. 1; and, FIG. 4 shows a block diagram of a functional representation of another embodiment of a method for setting a tank venting valve, including a regenerating precontrol value memory which is addressed by, among other things, the output value of a through-flow determining means.

The device for setting the tank venting valve includes: a regenerating precontrol value memory 30; a loading controller means 31, the operation of which is shown in detail in FIG. 2; an air mass multiplying means 32; a through-flow determining means 33, the operation of which is shown in detail in FIG. 3; a through-flow dividing means 34; a normalizing multiplying means 35; a converting means 36; and, a compensating means which acts as loading-multiplying means 37, subtracting means 38 and previously mentioned compensating-multiplying means 14.

The regenerating precontrol value memory stores fuel ratio numbers for the regenerating fuel mass/total fuel mass ratio, addressable via values of the rotational speed n and the load-dependent variable TL, for example the value 0.1 for mean rotational speed and mean load. This exemplary number means that when an operating condition occurs having the predetermined values of rotational speed and load for which the value 0.1 is stored, then up to 10% of the total fuel mass may be supplied by regenerating fuel mass. For the further discussion it is initially assumed that the regenerating gas flow contains an adequate proportion of fuel gas so that the permissible 10% can be delivered.

The fuel ratio number FTEFMA read out for the operating condition existing in each case is supplied to the loading controller means 31 which is also supplied with the control factor FR from the lambda controller stage 16. The loading controller means 31 operates in two component steps, namely in a recursion means 39 and a control means 40 which will now be explained in greater detail with reference to FIG. 2.

The recursion means 39 has a sample/hold step 41 which can be carried out, for example, by a memory cell in a microcomputer. This step 41 stores an assumed value for the loading factor FTEAD, for example the value zero on first start-up or the value which was calculated last. If the device is implemented by means of a microcomputer, then during each program run i a new loading factor FTEAD (i−1) is calculated from the loading factor FTEAD (i−1) calculated in the previous cycle, in accordance with the following recursion formula:

$$FTEAD(i) = FTEAD(i-1) - \Delta FR * LEKTE$$

wherein ΔFR is the positive or negative deviation of the control factor FR from the desired value one. This difference is formed by a desired value subtracting step 42 in the recursion means 39. LEKTE is an attenuating factor which effects that, depending on the value determined for it, the adaptation process for activating the tank venting valve does not occur too quickly but occurs in order to avoid control oscillations.

To carry out the recursion, the recursion means 39 operates with a recursion subtracting step 43 which is supplied with the loading factor FTEAD(i−1) from the previous computing cycle and the variable ΔFR * LEKTE and which forwards the newly calculated FTEAD(i) value for the loading factor to the sample/hold step 41.

From the fuel ratio number FTEFMA and the loading factor FTEAD, a gas ratio number is obtained by division which represents the ratio between the regenerating gas mass and the mass of total fuel. If the loading factor FTEAD is set to the value of zero or to a very small value at the beginning of the operation of the device, a high gas ratio number would be obtained, and thus a meaninglessly high value for the gas flow which should pass through the tank venting valve. Very high values for the required gas throughput can also occur during operation when the operating condition suddenly changes and thus the fuel ratio number read out of the regenerating precontrol value memory 30 performs a jump compared with the number previously read out. In order to avoid abrupt changes in the required value for the regenerating gas flow and, in particular, the jump to meaninglessly high values, the recursion means 39 is followed by the control means 40. In the computing steps there, the quotient of the fuel ratio number FTEFMA read out and the loading factor FTEAD determined by the recursion formula is formed. This value is supplied as desired value via a desired value/actual value comparison step 44 to an I-control step which has a normalized comparator step 45 and an integrator step 46. Only the output value supplied by the integrator step 46 is counted as gas ratio number FTEFVA. This output variable is subtracted from the desired value in the desired value/actual value comparison step 44. If the difference is positive, the normalizing comparator step 45 outputs the signal "plus 1" which leads to the gas ratio number FTEFVA being further integrated up by the integrator step 46. If the actual value output finally reaches the desired value and even exceeds it, the result of the normalizing comparator step 45 switches to the "minus 1" output signal, whereupon each integrator step 46 integrates down, that is, it reduces again the gas ratio number FTEFVA.

The gas ratio number is supplied to the air mass multiplying step 32 where it is multiplied by the present value for the air mass ML. If a multiplication by a normalizing factor were to occur at this point at the same time, a variable would be available which would be a direct measure of the required regenerating gas flow with the currently existing air flow ML. In the illustrative embodiment, however, this normalization only occurs after the flow-dividing step 34 in the normalizing multiplying step 35 so that a normalization to a predetermined maximum gas flow can be performed at the same time in the latter.

The through-flow determining means 33 according to FIG. 3 includes: an intake pressure characteristics memory 47; a pressure-dividing step 48; a flow characteristics memory 49; and, a pressure-multiplying step 50. These computing steps simulate the following physical relationship:

$$VREGNULL = PAMB \times F(PSAUG(TL)/PAMB)$$

The intake pipe pressure PSAUG is present at the outlet 26 of the tank venting valve 12 via the tank venting pipe 23 and changes essentially proportionally with the value of the load-indicating variable TL. This proportional relationship is stored in the intake pressure characteristics memory 47. It could also be calculated which, however, would required additional computing time. The relationship between the maximum gas flow VREGNULL through the continuously open tank venting valve 12 and the quotient QUOP between intake pressure PSAUG and ambient pressure PAMB is complex and can only be calculated with difficulty. The relationship is therefore stored in the flow characteristics memory 49.

The through-flow determining means 33 is supplied with available values of the load-indicating variable TL and of the ambient pressure PAMB. It takes the intake pressure valid for the predetermined load variable from the intake pressure characteristics memory 47 and divides this value by the ambient pressure PAMB in order to be able to take, with the aid of the quotient obtained in this manner a preliminary value for the maximum gas flow through the tank venting valve 12 from the flow characteristics memory 49. This value is then multiplied by the ambient pressure PAMB in the pressure multiplying step 50 and normalized in the normalizing multiplying step 35 to the ambient pressure for which the remaining characteristics and characteristic field values of the entire apparatus are determined.

After all these measures, a signal which is a direct measure of the open time of the tank venting valve 12 reaches the converting means 36. The value present in each case is converted by the converting means 36 into a pulse duty factor TAU for the actuator 51 of the tank venting valve 12. In this connection, it is already taken into consideration with the aid of the through-flow determining means 33 that different pulse duty factors are required for achieving one and the same gas flow with different pressure conditions. The through-flow determining means 33 is thus functionally more closely related to the converting means 36 than to the computing steps which are used for the actual calculation of the desired regenerating current. This value would already be present at the output of the air mass multiplying step 32 if the above-mentioned normalization had already been performed there.

The previously described functional groups of the device for setting the tank venting valve 12 operate as follows: it shall be assumed that the entire system is in equilibrium, that is, the injection time TI has been selected precisely correctly and precisely the required quantity of regenerating fuel in relation to the total fuel quantity is supplied through the tank venting tube 23. Now it is assumed that suddenly the loading factor of the regenerating gas flow is reduced, for example, due to the fact that the active carbon in the temporary reservoir 24 is largely regenerated. This leads to the fact that the internal combustion engine 10 is supplied with too lean a mixture. As a consequence, the control factor FR rises above the value of one, as a result of which the difference ΔFR to the desired value of one becomes positive. This positive value is subtracted from the value FTEAD(i−1) for the loading factor which is still stored in the sample/hold step and as a result, a new, smaller value FTEAD (i) is obtained. The fuel ratio number FTEFMA read out unchanged is divided by this smaller value in the loading dividing step 52, and as a result, the value supplied to the set point/actual-value comparison step 44 becomes greater. The ga ratio number FTEFVA is thereby integrated to a higher value than the previous value until it assumes the desired value. Due to this increase in the gas ratio number FTEFVA, the regenerating gas flow and thus the regenerating fuel quantity supplied to the intake pipe 22 through the tank venting pipe 23 is increased to such an extent that the internal combustion engine 10 is operated at the predetermined lambda desired value at which the control factor FR is again one.

To conclude the description of the operation of the system, the operation of the compensating means will now also be explained.

As soon as the loading factor FTEAD has been adjusted by the loading controller means 31 to the value which is actually applicable in the regenerating gas flow, the product of this value and the value of the gas ratio number FTEFVA results, in accordance with the definition, precisely in the ratio of regenerating fuel mass to total fuel mass, that is, the value 0.1 in the example. This value from the loading-multiplying step 37 is subtracted from the fixed value of one in the subtracting step 38, as a result of which a difference value, in the example the value 0.9 is supplied to the compensating multiplying step 14. The preliminary injection time TIV is multiplied by the value 0.9. The injection time is thus reduced, by 10% in the case of the example. Thus, the output value supplied to the injection valve 11 is reduced to such an extent that the fuel supplied to the internal combustion engine 10 by the injection valve is reduced (in comparison with the state in which no fuel at all is supplied via the tank venting valve 12) to such an extent that the injection valve 11 supplies to the internal combustion engine 10 that quantity of fuel less by which the supply via the tank venting valve 1 is increased.

Various special conditions can occur during the operation of the device. Such special conditions are separately taken into consideration in the exemplary embodiment. While the injection time is being adapted, no tank venting must occur and conversely. For this purpose, the above-mentioned injection adaptation switch 20, a venting adaptation switch 53 and an actuator switch 54 are provided. The venting adaptation switch 53 acts between the loading-multiplying step 37 and the subtracting step 38 which leads to the condition that the venting adaptation switch supplies, in its open condition, the desired value of one to the compensating multiplying step 14. The actuator switch 54 switches the actuator 51 for the tank venting valve 12 in such a manner that the tank venting valve is continuously closed when the switch is opened. During an adaptation period for the injection time, the venting adaptation switch 53 and the actuator switch 54 are opened (adaptation of the loading factor FTEAD by the recursion means 39 is stopped) and the injection adaptation switch 20 is closed while being exactly the opposite in periods for the adaptation venting. The period for the injection time adaptation is, for example, about one minute and the period for the adaptation of the tank venting is, for example, two minutes. With full load, regeneration is continuous with the loading factor remaining unchanged and temporarily FTEFVA=FTEFMA being set.

The following conditions, in particular, are considered to be special conditions which are taken into consideration by a special-condition stage in the control means 40. When the tank venting valve 12 is completely opened, the normalizing comparator step 45 is forced to output the value "minus 1" so that the integrator step 46 integrates downwards again. As a result, a limit-value control is effected. This correspondingly applies when the control factor FR runs towards limit values for rich or lean operation, for example towards the values 0.8 or 1.2, respectively. In other special conditions, the special condition means 55 directly influences the integrator step 46. For example, the special condition means 55 sets the output value of the integrator step 46 directly to the quotient of the fuel ratio number FTEFMA and the loading factor FTEAD when this quotient becomes smaller than the actual output value FTEFVA which is the case with a reduction in load. In this case, it is suddenly required that less fuel should be supplied. A further measure consists of influencing the rate of integration. The rate of integration is normally selected to be relatively low so that no oscillations occur in superposition with the integration characteristic of the lambda control means 16. Fast integration is selected, however, at the beginning of each adaptation period for the tank venting, until the control factor FR runs up against one of the previously mentioned limits or the tank venting valve is completely opened.

In order to be able to respond rapidly during special operating conditions, a special measure has also been taken in the recursion means 39. In this means, a learning factor dividing step 56 is used which divides a predetermined attenuating constant KONSTL for the learning by the output value FTEFVA of the integrator step 46 and thus obtains the attenuating factor LEKTE. This has the effect that the learning process is rapid when the gas throughput through the tank vent is still relatively low whereas the learning process, that is the recursion in the recursion means 39, occurs increasingly more slowly when the regenerating gas flow increases. This, too, reduces the tendency towards control oscillations.

Figure 4:
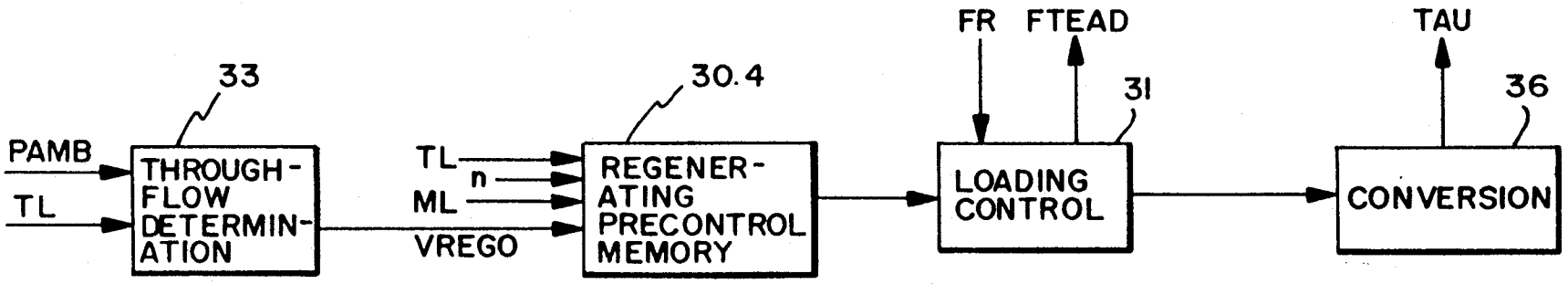

FIG. 4 shows a variant of the section of the operating sequence of FIG. 1 which is in FIG. 1 below the horizontal dot-dashed line. Of concern are the computing steps between the read-out of values from the regenerating precontrol memory 30 and the converting means 36. In the embodiment according to FIG. 4, only four computing step groups exist, namely: the through-flow determining means 33; a reading-out from a modified regenerating precontrol value memory 30.4; the loading controller means 31; and, the converting means 36.

In contrast to the embodiment according to FIG. 1, the regenerating precontrol value memory 30.4 of the embodiment according to FIG. 4 can be controlled not only via values of two operating variables but via values of four operating variables. These values are: values of the load-indicating variable TL; values of the rotational speed n; values of the air flow ML; and, values of the maximum gas flow VREGNULL. Of the two addressing variables of load-indicating variable TL and air flow ML, one can be omitted since these variables can be converted into one another with the aid of the rotational speed n and a constant. Due to the fact that the values stored in the memory 30.4 already take into account the air flow ML and the maximum gas flow VREGNULL, the air mass multiplying step 32, the flow-dividing step 34 and the normalizing multiplying step 35 have been omitted in comparison with the embodiment according to FIG. 1. As a result, the loading controller means 31 does not receive fuel ratio numbers but preliminary values for pulse duty factors. This is due to the fact that the pulse duty factor dependence on pressure ratios for predetermined regenerating gas flows is already taken into consideration via values for the maximum gas flow VREGNULL through the tank venting valve 12. The loading controller means 31 processes these more complex values instead of the fuel ratio numbers.

The embodiment according to FIG. 4 has the advantage of very short computing time since fewer arithmetic computing steps must be performed than in the embodiment according to FIG. 1. On the other hand, a greater regenerating precontrol value memory 30.4 is required and the method can be less well adapted to different conditions of use.

It would be a step in the opposite direction if, instead of the regenerating precontrol value memory 30 of the embodiment according to FIG. 1, a memory were to be used in which only the relationship between the fuel ratio numbers and the load variable TL is stored while the dependence of the rotational speed n would be taken into consideration by a subsequent multiplying step. Progressing even further in the direction of arithmetics, the memory just mentioned could also be omitted and a fuel ratio number required for each value of the load variable TL could be calculated from a mathematical function.

It is left to the expert to determine which arithmetic functions are actually carried out and which functions are already taken into consideration right from the start in stored values. The embodiment according to FIG. 1 forms a good optimization. However, all methods according to the invention are distinguished by the fact that they include a flow-determining means and a loading controller means for modifying values which have been read out or calculated.

The conversion means 36 in the exemplary embodiment of FIGS. 1 and 4 operates in accordance with a method for determining the pulse duty factor which is particularly advantageous for the present application. This is because the operation proceeds in such a manner that the open or closing times of the tank venting valve 12 are as short as possible.

It shall be assumed that the tank venting valve 12, with reliable operation, exhibits a minimum open time of 5 ms and a closing time of the same value. If these values are shortened, for example to 3 ms, it is no longer ensured that the time selected is really maintained. If a pulse duty factor of 50% is to be set, an open time of 5 ms and a closing time of 5 ms are selected. For a pulse duty ratio of 4:1, 20 ms open time and 5 ms closing time are used and, conversely, an open time of 5 ms and a closing time of 20 ms for a pulse duty ratio of 1:4. Thus, the frequency is 100 Hz with a pulse duty ratio of 1:1, whereas it is 40 Hz in the two other examples. If a minimum frequency, for example 10 Hz is reached, this is no longer reduced further but the open or closing time is now lowered below the value for reliable operation; with a pulse duty ratio of 20:1, an open time of about 99 ms and a closing time of about 1 ms is thus used. Although, because of the unreliable mode of operation with this short closing time, it is not ensured that the required pulse duty factor is really set, deviations are insignificant for practical operation in these extreme cases.

The measure has the effect that in no case pulse frequencies and open or closing times are obtained in which the alternating opening and closing of the tank venting valve leads to noticeable changes in torque.

In the method step of taking into consideration the pressure conditions at the tank venting valve by means of the flow-determining stage, which is of particular importance for the invention, the external air pressure PAMB is used. This can either be measured directly or can be calculated from adaptation variables of the injection adaptation stage 19. The latter is based on the finding that adaptation of the precontrol values for the injection is required, in particular, because of air pressure fluctuations.

We claim:

1. A method for obtaining output values for actuating a tank venting valve connected to the intake pipe of an internal combustion engine in a control system with a lambda control arrangement for controlling the lambda value of the air/fuel mixture to be supplied to the engine on the basis of a lambda control factor which influences the fuel metering device, the method comprising the steps of:

calculating the maximum possible gas flow (VREGNULL) through the tank venting valve at the pressure conditions present for a particular operating condition;

predetermining precontrol values of a variable, which is a measure of the required regenerating fuel quantity, in dependence on at least the air flow (ML) through the intake pipe and the maximum gas flow (VREGNULL) through the tank venting valve;

modifying the precontrol values by dividing by a loading factor (FTEAD) and by controlling to the divided value, which loading factor is changed, starting with its present value, in dependence on the value of the lambda control factor (FR), in such a manner that it leads to a change in the regenerating fuel quantity to be output, in the particular direction which results in a change in the lambda control factor towards a control factor desired value;

converting the modified value into an output value for the tank venting valve; and, reducing the output value (TI) to be supplied to the fuel metering device for reducing the quantity of fuel supplied to the internal combustion engine by this device in comparison to the state in which no fuel is supplied via the tank venting valve, in each case to such an extent that the fuel metering device essentially supplies to the internal combustion engine that quantity of fuel less by which the supply via the tank venting valve is increased.

2. An apparatus for obtaining output values for actuating a tank venting valve connected to the intake pipe of an internal combustion engine in a control system with a lambda control arrangement for controlling the lambda value of the air/fuel mixture to be supplied to the engine on the basis of a lambda control factor which influences the fuel metering device, the apparatus comprising:

through-flow determining means for determining the maximum gas-flow (VREGNULL) through the tank venting valve;

a regenerating precontrol value memory for storing preliminary values for the regenerating gas flow, said memory being addressable via values of the rotational speed (n), of the air flow (ML) and of the maximum gas flow (VREGNULL) through the tank venting valve;

loading controller means for determining the loading factor and for dividing the precontrol value by this loading factor and for then controlling the output value (FTEFVA) of said loading controller means to the divided value, said precontrol value being read out for a particular set of values of addressing operating variables;

converting means for converting the output value (FTEFVA) from the loading controller means into an output value (TAU) for the actuator of the tank venting valve; and, compensating means for the reducing the output value (TI) to be supplied to the fuel metering device.

3. The apparatus of claim 2, wherein: said through-flow determining means includes a through-flow characteristics memory for storing values for the maximum possible gas flow at a predetermined pressure ratio, said memory being addressable via predetermined values of the pressure ratio.

4. The apparatus of claim 3, said through-flow determining means including an intake pressure characteristics memory for storing values for the intake pressure (PSAUG) behind the throttle valve, said intake pressure characteristics memory being addressable via predetermined values of a load variable (TL).

5. The apparatus of claim 4, said through-flow determining means being supplied with values indicating the ambient pressure (PAMB).

6. The apparatus of claim 5, comprising a special-condition stage for setting said loading controller means to predetermined operating conditions when predetermined operating conditions occur.

7. The apparatus of claim 6, said converting means being adapted to calculate pulse duty factor values (TAU) in such a manner that with an opening pulse duty factor of greater than 50%, the opening time for the tank venting valve is kept at the minimum possible value for proper operation and the closing time is varied, and with an opening pulse duty factor of less than 50%, the closing time is kept at the minimum possible value for proper operation and the open time is varied.

8. The apparatus of claim 7, said converting means being further adapted to limit the pulse frequency to a minimum value and, when this is reached, to lower the open time or the closing time below the minimum value for proper operation, depending on the pulse duty factor which is required at that time.

9. An apparatus for obtaining output values for actuating a tank venting valve connected to the intake pipe of an internal combustion engine in a control system with a lambda control arrangement for controlling the lambda value of the air/fuel mixture to be supplied to the engine on the basis of a lambda control factor which influences the fuel metering device, the apparatus comprising:

a regenerating precontrol value memory for storing fuel ratio numbers (FTEFMA) for the regenerating fuel mass/total fuel mass ratio, said memory being addressable via values of addressing operating variables (n, TL);

loading controller means for determining the loading factor (FTEAD) and dividing the fuel ratio number by this loading factor and for controlling the output value (FTEFVA) of said controller means to the divided value, said precontrol value being read out for a set of values of addressing operating variables for obtaining a gas ratio number (FTEFVA);

multiplying means for multiplying the gas ratio number by the value of the air flow (ML) supplied to the engine for obtaining a value for the regenerating gas flow;

through-flow determining means for determining the maximum gas flow (VREGNULL) through the tank venting valve;

dividing means for dividing the value for the regenerating gas flow by the maximum gas flow at the particular operating condition;

converting means for converting the divided value into an output value (TAU) for the actuator for the tank venting valve; and, compensating means for reducing the output value (TI) to be supplied to the fuel metering device.

10. The apparatus of claim 9, wherein: said through-flow determining means includes a through-flow characteristics memory for storing values for the maximum possible gas flow at a predetermined pressure ratio, said memory being addressable via predetermined values of the pressure ratio.

11. The apparatus of claim 10, said through-flow determining means including an intake pressure characteristics memory for storing values for the intake pressure (PSAUG) behind the throttle valve, said intake pressure characteristics memory being addressable via predetermined values of a load variable (TL).

12. The apparatus of claim 11, said through-flow determining means being supplied with values indicating the ambient pressure (PAMB).

13. The apparatus of claim 12, comprising a special-condition stage for setting said loading controller means to predetermined operating conditions when predetermined operating conditions occur.

14. The apparatus of claim 13, said converting means being adapted to calculate pulse duty factor values (TAU) in such a manner that with an opening pulse duty factor of greater than 50%, the opening time for the tank venting valve is kept at the minimum possible value for proper operation and the closing time is varied, and with an opening pulse duty factor of less than 50%, the closing time is kept at the minimum possible value for proper operation and the open time is varied.

15. The apparatus of claim 14, said converting means being further adapted to limit the pulse frequency to a minimum value and, when this is reached, to lower the open time or the closing time below the minimum value for proper operation, depending on the pulse duty factor which is required at that time.

16. The apparatus of claim 3, wherein a throttle flap is arranged in the intake pipe in which an intake pressure PSAUG is present behind the throttle flap; and, said predetermined pressure ration being said intake pressure PSAUG to ambient pressure PAMB.

17. The apparatus of claim 10, wherein a throttle flap is arranged in the intake pipe in which an intake pressure PSAUG is present behind the throttle flap; and, said predetermined pressure ration being said intake pressure PSAUG to ambient pressure PAMB.

* * * * *

UNITED STATES PATENT AND TRADEMARK OFFICE

CERTIFICATE OF CORRECTION

PATENT NO. : 5,072,712

DATED : December 17, 1991

INVENTOR(S) : Ulrich Steinbrenner, Günther Plapp and Wolfgang Wagner

It is certified that error appears in the above-identified patent and that said Letters Patent is hereby corrected as shown below:

In column 3, line 63: delete "tim" and substitute -- time -- therefor.

In column 9, line 12: delete "ga" and substitute -- gas -- therefor.

In column 9, line 46: delete "valve 1" and substitute -- valve 12 -- therefor.

In column 13, line 2: delete "gas-flow" and substitute -- gas flow -- therefor.

In column 14, line 61: delete "ration" and substitute -- ratio -- therefor.

In column 14, line 66: delete "ration" and substitute -- ratio -- therefor.

Signed and Sealed this

Fourth Day of May, 1993

*Attest:*

Michael K. Kirk

MICHAEL K. KIRK

*Attesting Officer*

*Acting Commissioner of Patents and Trademarks*